US005761874A

United States Patent [19]

Hayakawa

[11] Patent Number: 5,761,874

[45] Date of Patent: Jun. 9, 1998

[54] CONCRETE FORM SPACING FIXTURE

[76] Inventor: Yoshiyuki Hayakawa, 5-22, Miyanomori 2-jo 12-chome, Chuo-ku, Sapporo-shi, Hokkaido, Japan

[21] Appl. No.: 700,897

[22] Filed: Aug. 21, 1996

[30] Foreign Application Priority Data

Aug. 30, 1995 [JP] Japan ..... 7-221801
Jun. 13, 1996 [JP] Japan ..... 8-152222

[51] Int. Cl.[6] ..... E04B 1/38

[52] U.S. Cl. ..... 52/701; 52/699; 249/40; 249/43

[58] Field of Search ..... 52/698, 699, 700, 52/561, 562, 564; 249/40, 43

[56] References Cited

U.S. PATENT DOCUMENTS 1,680,923 8/1928 Williams .
5,332,189 7/1994 Tseng ..... 249/40
5,497,592 3/1996 Boeshart ..... 52/699

FOREIGN PATENT DOCUMENTS

A-2528094 12/1983 France .
A-2531739 2/1984 France .
A-9314656 1/1994 Germany .
A-7613977 6/1978 Netherlands .
225811 12/1996 Taiwan .
A-1594781 8/1981 United Kingdom .

*Primary Examiner*—Carl D. Friedman
*Assistant Examiner*—Yvonne Horton-Richardson
*Attorney, Agent, or Firm*—Lowe, Price, LeBlanc & Becker

[57] ABSTRACT

A concrete form spacing fixture comprises a bar type separator having a prescribed length which is provided with a male screw on its end portion, an attachment which is provided with a concave part having an open end and so formed that the open end of the concave part defines an end surface perpendicular to the longitudinal direction of the separator in a state fixed to the end portion of the separator, and a fastening member having a female screw forming part provided with a female screw to be fitted with the male screw of the separator with an outer diameter smaller than an opening diameter of the open end of the concave part of the attachment on an end thereof so that a flange type stop part is provided on a base portion of the female screw forming part. According to this structure, no male screw is inserted in a hole of a form panel, whereby the form panel is prevented from breakage caused by a bite of a thread. Consequently, workability in assembling of a concrete form is improved while long-term reuse of the form panel is enabled.

6 Claims, 11 Drawing Sheets

CONCRETE FORM SPACING FIXTURE

BACKGROUND OF THE INVENTION

1. Field of the Invention

The present invention relates to a concrete form spacing fixture for fixing opposite form panels forming a concrete placing part to each other while spacing these form panels in assembling of a concrete form which is employed for concrete placing or molding of concrete secondary products in construction or civil engineering work, for example.

2. Description of the Background Art

An exemplary concrete form spacing fixture for fixing a pair of form panels 70 to each other at a prescribed distance through a concrete placing space in case of assembling a concrete form by the form panels 70 each of which is prepared by nailing and fixing a flat plate 71 consisting of a plywood board to a plurality of reinforcing crossbars 72 is now described with reference to FIGS. 10A to 12.

In this prior art, a member which is mainly formed by a separator 21, an attachment 22 and a fastening member 23 is employed as a spacing fixture for fixing the opposite form panels 70 to each other while spacing the same. As shown in FIGS. 10A and 10B, the separator 21 is formed by a bar which is provided with a pair of male screws 21 on both ends thereof (only one of these ends appears in the figures). Each male screw 21*a* is fitted with a female screw 22*c* which is provided on a first end of the attachment 22 shown in FIG. 10A. A male screw 22*d* which is formed on a second end of the attachment 22 substantially coaxially with the female screw 22*c* passes through a spacing fixture mounting hole 76 provided in each form panel 70 as shown in FIG. 10B, so that an end portion of a substantially truncated-conical presser part 22*a* of resin which is engaged with the outer periphery of an attachment body part 22*b* comes into contact with a concrete placing surface of the form panel 70. A female screw 23*a* which is provided on a first end of the fastening member 23 is fitted with the male screw 22*d* of the attachment 22, whereby the attachment 22 is clamped/fixed to the form panel 70.

FIG. 11 illustrates a state of fastening/fixing a pair of opposite form panels 70 to each other by a plurality of the conventional concrete form spacing fixtures shown in FIGS. 10A and 10B for assembling a concrete form.

A male screw 23*b* is provided on a second end of each fastening member 23, so that a pair of thin angular cylindrical form support members 26 of a metal are opposed to each other through each fastening member 23 by a support member 24 and a nut 25 which are mounted on this male screw 23*b*, thereby bridging a plurality of transversely arranged form panels 70 with each other.

However, the aforementioned conventional concrete form spacing fixture has the following problems: In order to assemble the pair of form panels 70 with the separator 21, the attachment 22 and the fastening member 23, the male screw 22*d* of the attachment 22 is inserted in the spacing fixture mounting hole of a first one of the form panels 70 so that an end portion of the presser part 22*a* is brought into contact with a concrete placing surface of this form panel 70 and the female screw 23*a* of the fastening member 23 is fitted with the male screw 22*d* for fixing the attachment 22 and the fastening member 23 to each other. At this time, the form panel 70 is held by an end surface of the presser part 22*a* of the attachment 22 on the male screw 22*d* side and an end surface of a flange end part 23*c* of the fastening member 23, to be fastened/fixed. Thereafter the first male screw 21*a* of the separator 21 is fitted with the male screw 22*c* of the fixed attachment 22, for fixing the separator 21. The male screw 22*c* of a second attachment 22 is fitted with and fixed to the second male screw 21*a* of the fixed separator 21.

The male screw 22*d* of the second attachment 22 which is fixed in the aforementioned manner is inserted in the spacing fixture mounting hole 76 of the second form panel 70, and an end of the presser part 22*a* of this attachment 22 is brought into contact with a concrete placing surface of this form panel 70. In this state, the male screw 23*a* of a second fastening member 23 is fitted with and clamped to the male screw 22*d* of the attachment 22 projecting from the outer side surface of the form panel 70, whereby the pair of opposite form panels 70 are fastened/fixed to each other while keeping a space therebetween.

When the aforementioned concrete form spacing fixture is employed for assembling the pair of opposite form panels 70 in the aforementioned manner, the position of the male screw 22*d* of the second attachment 22 hardly correctly coincides with the arrangement position of the corresponding spacing fixture mounting hole 76 of the second form panel 76 in case of inserting this male screw 22*d* in the spacing fixture mounting hole 76 while fastening the first fastening member 23 and the first attachment 22 to the first form panel 70 and fixing the separator 21 and the second attachment 22. Thus, it is necessary to manually insert each male screw 22*d* in each spacing fixture mounting hole 76 after aligning the form panels 70 with each other, leading to extremely inferior workability.

In the aforementioned conventional concrete form spacing fixture, further, the male screw 22*d* of each attachment 22, which is inserted in the corresponding spacing fixture mounting hole 76 of each form panel 70 in assembling, is strongly pressed against the inner peripheral surface of the spacing fixture mounting hole 76 by concrete pressure in concrete placing or the like, leading to a bite of its thread. When the concrete form is detached after employment, therefore, the spacing fixture mounting hole 76 portion of each form panel 70 is disadvantageously broken to allow no further reuse.

In this prior art, further, it comes to that the attachment 22 supports tensile force between the separator 21 and the fastening member 23 in the state fastened to each form panel 70. Consequently, the attachment 22, which must have sufficient tensile strength, cannot be molded from a simple substance of resin, and a portion subjected to tensile force must be reinforced by a metal member.

In addition, the aforementioned conventional concrete form spacing fixture premises that the attachment is removed after concrete placing. Thus, a time is required for the removal, leading to increase of the execution cost for construction work.

SUMMARY OF THE INVENTION

An object of the present invention is to provide a concrete form spacing fixture which improves workability in assembling of a concrete form, prevents breakage of a form panel, and has a structure with no requirement of high strength for an attachment.

Another object of the present invention is to provide a concrete form spacing fixture which enables execution with no removal of an attachment from concrete after concrete placing.

In an aspect of the present invention, the inventive concrete form spacing fixture for solving the aforementioned problems comprises a bar type separator having a prescribed length which is provided with a male screw on its end portion, an attachment which is provided with a concave part having an open end and so formed that the open end of the concave part defines an end surface perpendicular to the longitudinal direction of the separator in a state being fixed to the end portion of the separator, and a fastening member having a female screw forming part which is provided with a female screw to be fitted with the male screw of the separator with an outer diameter smaller than an opening diameter of the open end of the concave part of the attachment on an end thereof so that a stop part having a diameter enlarged in the form of a flange is provided on a base portion of the female screw forming part.

Due to this structure, the female screw forming part of the fastening member is inserted in a hole of a concrete form and the male screw of the separator is fitted with the female screw of the fastening member in the inner side of the concave part of the attachment which is fixed to the end portion of the separator in mounting on the concrete form, for holding and fastening/fixing the concrete form by the open end of the attachment and the stop part of the fastening member.

Thus, inserted in the hole of the concrete form is the female screw forming part of the fastening member, and no thread of a male screw directly comes into contact with the inner peripheral surface of the hole of the form, dissimilarly to the prior art. Consequently, a form panel is prevented from breakage resulting from a bite of a male screw dissimilarly to the prior art, whereby long-term reuse of the form panel is enabled.

Further, the male screw of the separator is directly fitted with the female screw of the fastening member so that the attachment simply serves only as a contact member for a form panel for defining a space between this form panel and another form panel which is opposed thereto and no tensile force between the separator and the fastening member directly acts on the attachment, whereby no high tensile strength is required for the attachment.

Thus, it is possible to form the overall attachment by an integrally molded product of resin, whereby the material cost and productivity can be improved.

In a preferred embodiment of this aspect of the present invention, a waterproof flange part having a diameter which is perpendicularly enlarged in the longitudinal direction of the separator is provided on the other end of the attachment. According to this structure, infiltration of water or the like through a hole in concrete receiving the separator is prevented in a state leaving the attachment in the concrete after concrete placing. Consequently, no time is required for removing the attachment after concrete placing, whereby the execution cost is reduced.

In another aspect of the present invention, the inventive concrete form spacing fixture comprises a bar type separator having a prescribed length which is provided with a pair of male screws on both end portions, a pair of attachments having closed ends and open ends to be in the form of truncated cones with diameters gradually increased from the closed ends toward the open ends and provided with female screws passing through the closed ends coaxially with the central axes of the truncated cones to be fitted with the pair of male screws of the separator respectively, and a pair of bar type fastening members having female screw forming parts provided with female screws to be fitted with single ones of the male screws of the separator respectively with outer diameters smaller than opening diameters of the open ends of the attachments on first ends thereof so that stop parts having diameters which are enlarged in the form of flanges are provided on base portions of the female screw forming parts. The respective ones of the pair of male screws of the separator have prescribed lengths which are longer than the lengths of the female screws of the attachments and shorter than the distances between the closed ends and the open ends of the attachments, so that the female screw forming parts of the fastening members are inserted in holes of a concrete form and the respective ones of the pair of male screws of the separator are fitted with and clamped to the female screws of the fastening members in mounting on the concrete form. Thus, the stop parts of the fastening members and the open ends of the attachments are fastened/fixed to each other by holding the concrete form, thereby fixing a pair of form panels to each other while oppositely spacing the same.

Due to such a structure, the concrete form spacing fixture according to this aspect of the present invention has the following specific function/effect, in addition to a function/effect similar to that of the concrete form spacing fixture according to the first aspect:

After one of the fastening members, one of the attachments and the separator are fastened/fixed to one of the form panels, it is not necessary to insert the male screw of the other attachment in a hole of the form from a concrete placing surface of the other form panel dissimilarly to the prior art shown in FIGS. 10A and 10B, but it is possible to readily fasten/fix the other fastening member by inserting the female screw forming part of this fastening member in the hole of the form from outside and aligning an end portion of the female screw forming part of the fastening member projecting toward a concrete placing surface of the form with the male screw of the separator fitted with the female screw of this female screw forming part. Thus, workability in assembling of a concrete form can be remarkably improved.

Also in this aspect of the present invention, waterproof flange parts having diameters which are enlarged perpendicularly in the longitudinal direction of the separator are provided on the closed ends of the attachments in a preferred embodiment. According to this structure, infiltration of water or the like through a hole in concrete receiving the separator is prevented in a state leaving the attachments in the concrete after concrete placing similarly to the above. Consequently, no time is required for removing the attachments after concrete placing, whereby the execution cost is reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A first embodiment of the present invention is now described with reference to FIGS. 1A to 3.

Figure 1A:
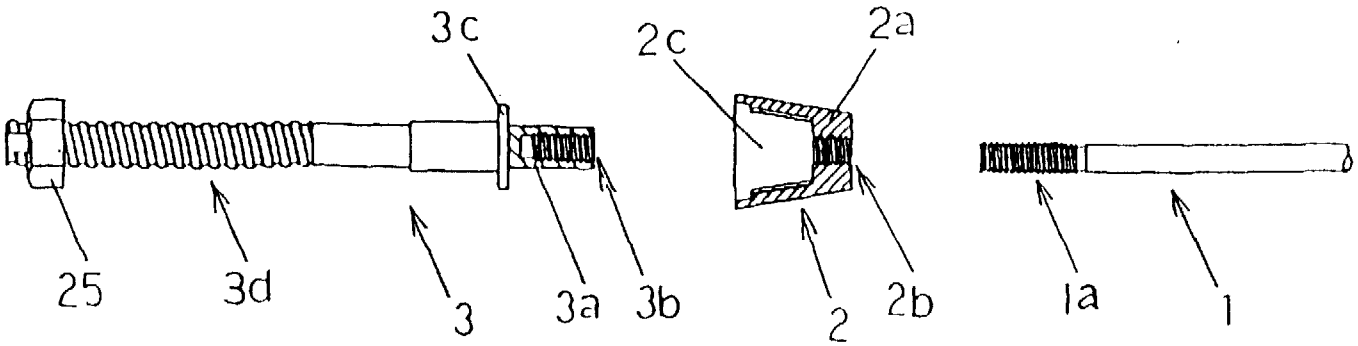
FIG. 1A is a sectional view showing a concrete form spacing fixture according to a first embodiment of the present invention in an exploded manner.
Figure 1B:
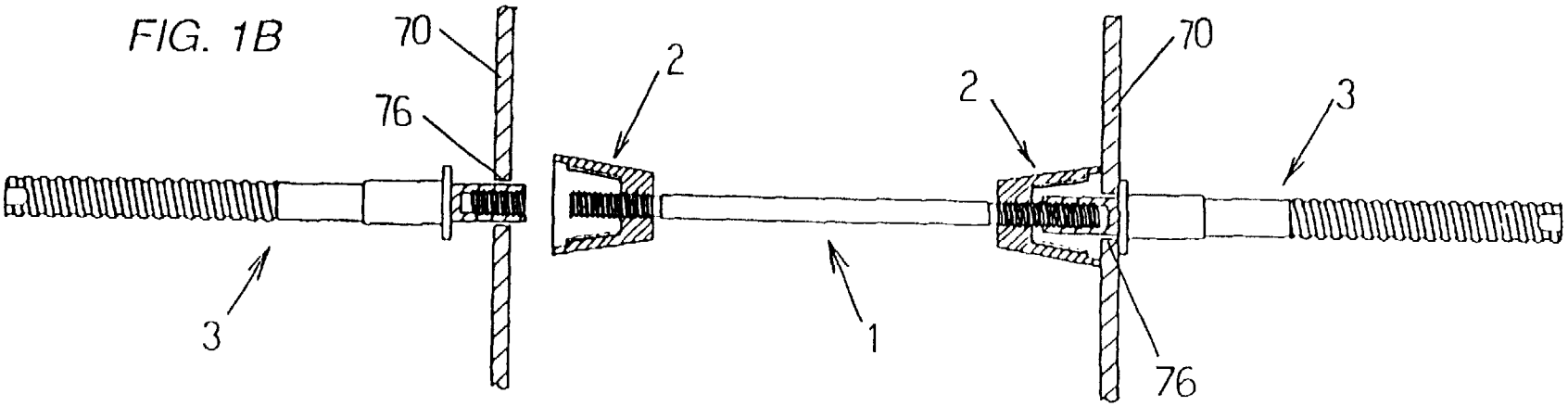
FIG. 1B is a sectional view showing a state of fastening/fixing a pair of opposite form panels to each other by the concrete form spacing fixture shown in FIG. 1A.

Referring to FIGS. 1A and 1B, a concrete form spacing fixture according to the first embodiment of the present invention is formed by a separator 1, an attachment 2 and a fastening member 3. The separator 1 is basically in common with the separator 21 employed in the prior art in a point that male screws 1*a* are provided on both ends (only one of these ends appears in FIGS. 1A and 1B), while each male screw 1*a* of the separator 1 is slightly longer than each male screw 21 of the separator 21 in the prior art.

The attachment 2 is provided on a closed end of its resin presser part 2*a* with a female screw 2*b* which is fitted with one of the male screws 1*a* of the separator 1. A concave part 2*c* is provided on an open end of the attachment 2, which is in the form of a truncated cone having a diameter gradually increased from the closed end toward the open end as a whole.

The fastening member 3 is in common with the fastening member 23 in the prior art in a point provided with a flange type stop part 3*c* and a male screw part 3*d*, and different in a point provided with a female screw forming part 3*a* having the stop part 3*c* as a base end on an end portion which is opposite to that provided with the male screw 3*d* so that a female screw 3*b* to be fitted with a forward end portion of the male screw 1*a* of the separator 1 is provided on this portion. The male screw 3*d* of the fastening member 3 is fitted with a nut 25 similarly to the aforementioned prior art, for fixing a form support member.

In order to fasten/fix a pair of opposite form panels 70 to each other with such concrete form spacing fixtures according to the first aspect of the present invention having the aforementioned structure, the female screw forming parts 3*a* of the fastening members 3 are inserted in spacing fixture mounting holes 76 of the form panels 70 as shown in FIG. 1B, so that the stop parts 3*c* are in contact with the outer side surfaces of the form panels 70. Then, the female screws 2*b* of the attachments 2 are fitted with the base ends of the male screws 1*a* of the separator 1 so that the female screws 3*b* of the fastening members 3 are fitted with the forward ends of the male screws 1*a* of the separator 1 projecting into the concave parts 2*c* of the attachments 2, for fastening/fixing the form panels 70 to each other while holding the same by open end surfaces of the attachments 2 and the stop parts 3*c* of the fastening members 3. Such operations are successively performed on the pair of form panels 70, whereby the pair of opposite form panels 70 can be fixed to each other while keeping a constant space therebetween.

Figure 2A:
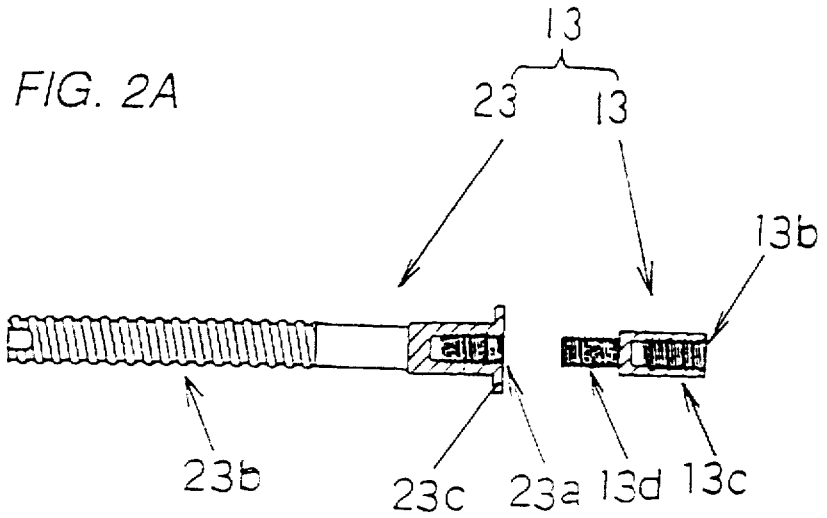
FIG. 2A is a sectional view showing a modification of a fastening member of the concrete form spacing fixture according to the first embodiment of the present invention which is formed by combining an attachment with a conventional member in an exploded manner.
Figure 2B:
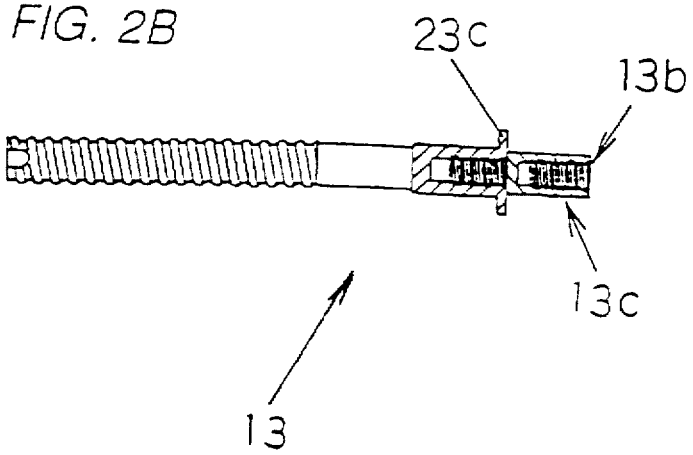
FIG. 2B is a sectional view showing an integral fastening member formed by mounting the attachment.

While the fastening member 3 according to this embodiment can be formed by a integral metal bar, a fastening member 13 having a function which is substantially identical to that of the integral fastening member 3 can alternatively be employed as shown in FIG. 2B, by fitting a male screw 13*d* of an adaptor 13 having a female screw forming part 13*c* provided with a female screw 13*b* on its one end and the male screw 13*d* on the other end with the female screw 23*a* of the fastening member 23 employed in the prior art, as shown in FIG. 2A.

Figure 3:
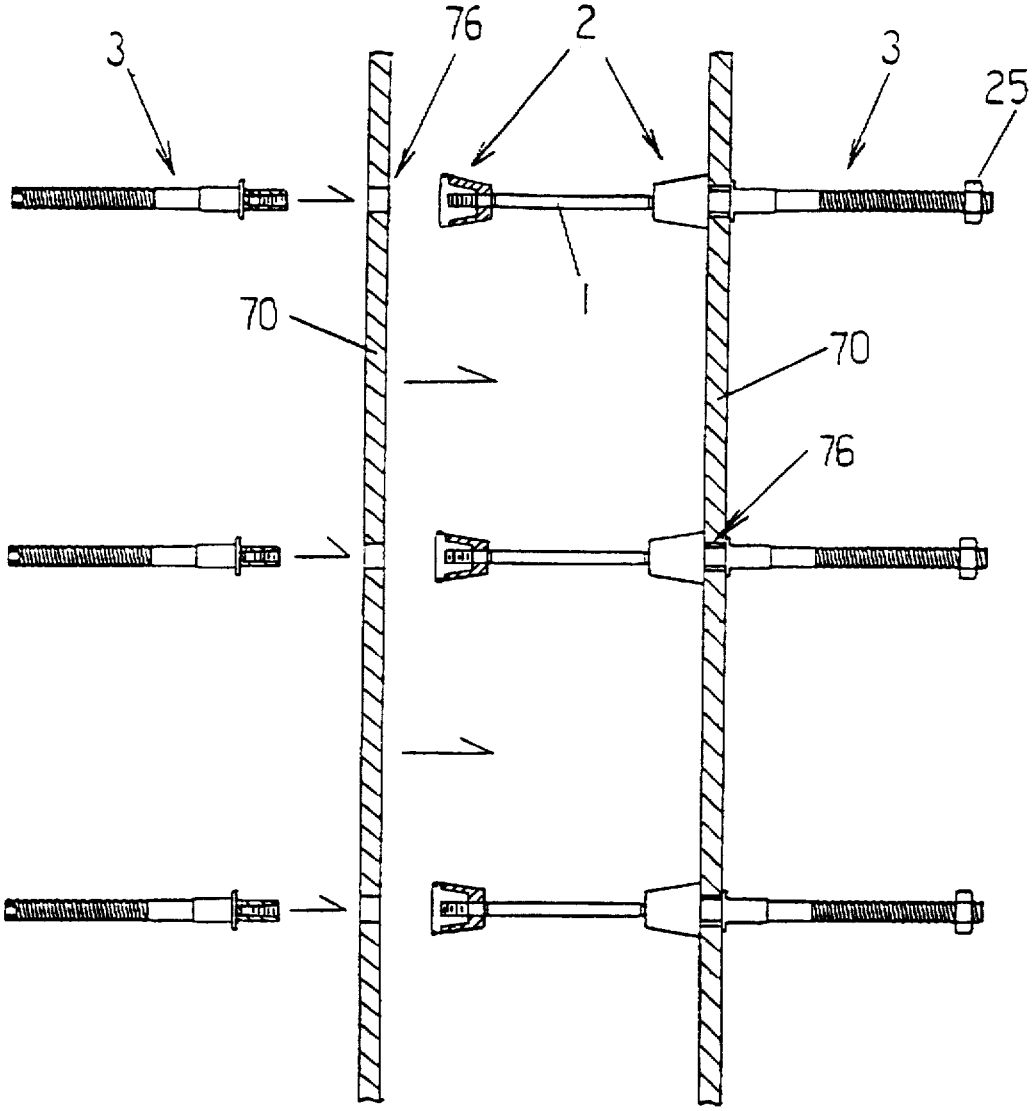
FIG. 3 is a sectional view showing a state of fastening/fixing a pair of opposite form panels 70 to each other with a plurality of concrete form spacing fixtures according to the first embodiment shown in FIG. 1 for assembling a concrete form.
Figure 4A:
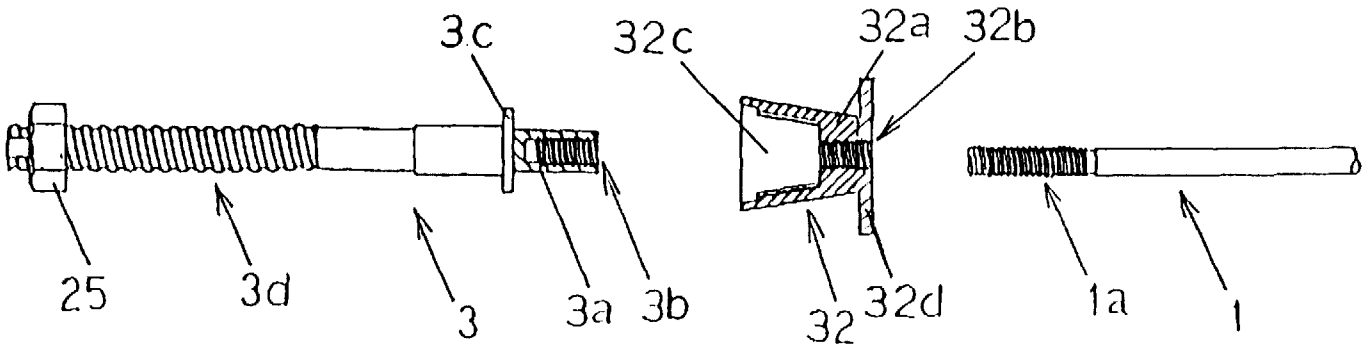
FIGS. 4A and 4B are sectional views showing a concrete form spacing fixture according to a second embodiment of the present invention in correspondence to FIGS. 1A and 1B respectively.
Figure 4B:
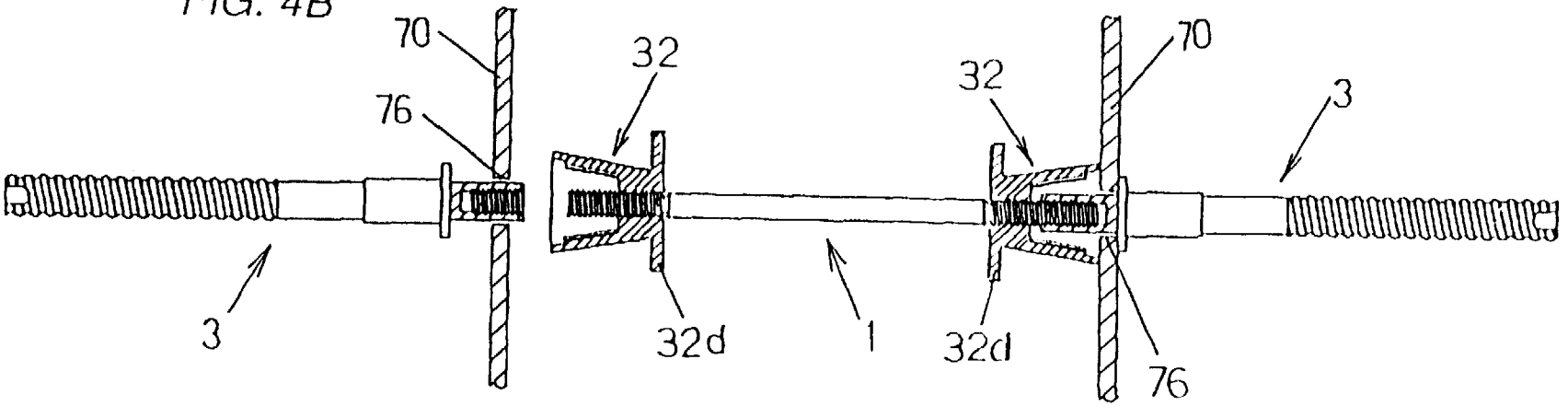

A working procedure of fixing opposite form panels 70 to each other with a plurality of concrete form spacing fixtures according to this embodiment is now described with reference to FIG. 3. First, the female screw forming parts 3*a* of first ones of pairs of fastening members 3 are inserted in respective spacing fixture mounting holes 76 of one of the pair of opposite form panels 70 and the stop parts 3*c* are brought into contact with the outer side surface of this form panel 70, so that pairs of attachments 2 are fitted with base ends of the male screws 1*a* provided on both ends of the separators 1 and first ones of the male screws 1*a* of the separators 1 are fitted with and fastened/fixed to the female screws 3*b* of the fastening members 3. In this state, respective spacing fixture mounting holes 76 of the other form panel 70 are aligned with the corresponding attachments 2 while the female screw forming parts 3*a* of the second fastening members 3 are inserted in the respective spacing fixture mounting holes 76 so that the second male screws 1*a* of the separators 1 and the female screws 3*b* of the fastening members 3 facing the same are fitted with each other in inner sides of the concave parts 2*c* of the attachments 2 and both side surfaces of the form panels 70 are held by the open end surfaces of the attachments 2 and the stop parts 3*c* of the fastening members 3 to be fastened/fixed. These operations are successively performed on the plurality of fastening members 3, whereby the pair of opposite form panels 70*a* are fixed to each other while keeping *a* constant space therebetween, thereby enabling concrete placing.

Figure 12:
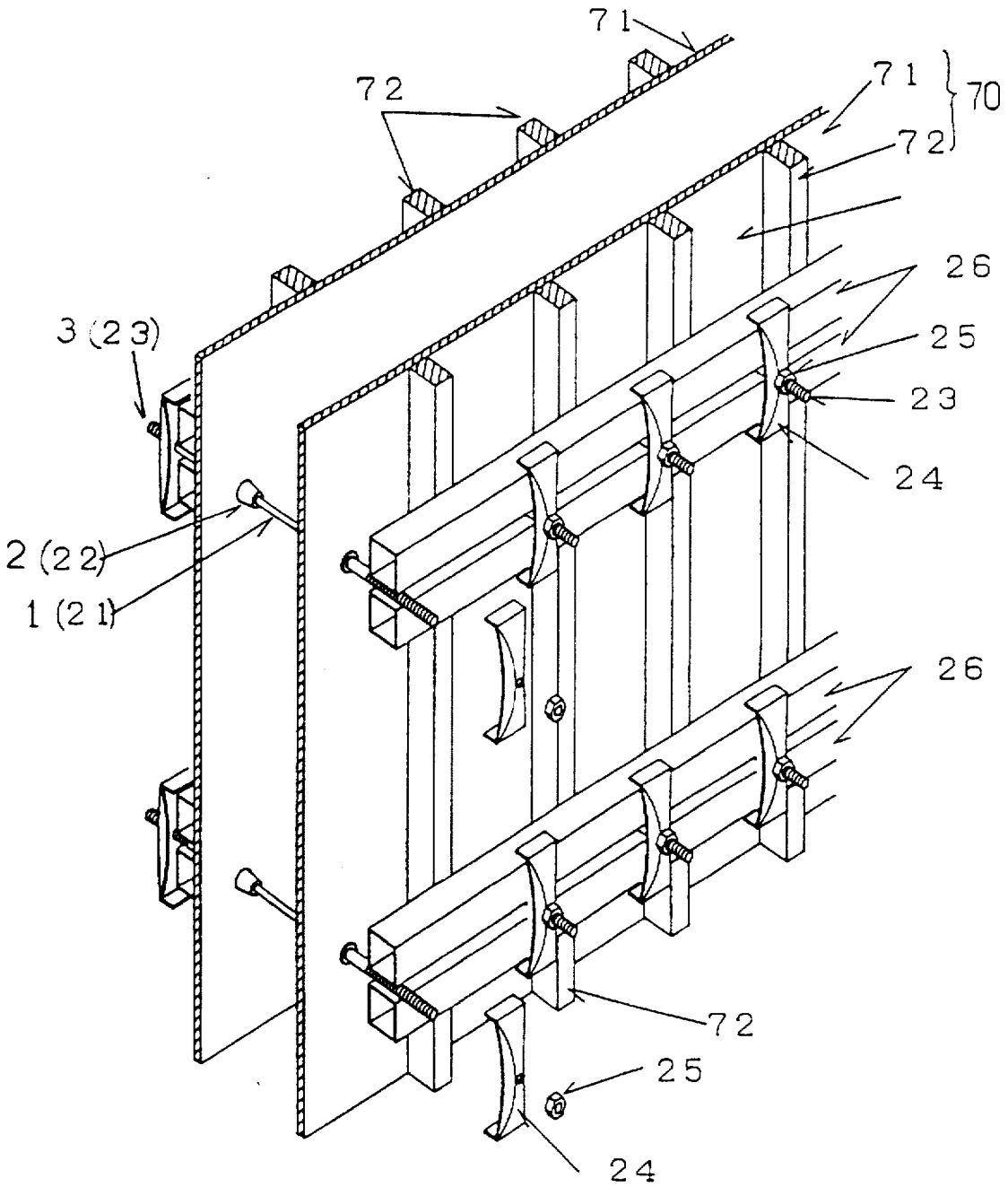
FIG. 12 PRIOR ART
FIG. 12 is a partially fragmented sectional view showing a state of assembling a wood concrete form with the inventive or conventional concrete form spacing fixtures.

A perspective view showing the appearance of a wood form which is assembled with the concrete form spacing fixtures according to this embodiment is similar to FIG. 12 showing the prior art.

Due to employment of the concrete form spacing fixtures according to this embodiment, no male screw parts are inserted in the spacing fixture mounting holes 76 of the form panels 70 and hence no threads bite into the form panels 76, as hereinabove described. Even if large concrete pressure acts in concrete placing, therefore, the form panels 76 are not broken but can be repeatedly reused over a long period of time.

When the second one of the pair of opposite form panels 70 is aligned with the first form panel 70 after the first ones the fastening members 3, the first ones of the attachments 2 and the separators 1 are fastened/fixed to the first form panel 70, no operation of inserting male screws in the spacing fixture mounting holes 76 of the second form panel 70 on a concrete form surface side, i.e., inside the pair of form panels 70, but the female screw parts 3*a* of the second fastening members 3 can be inserted from outside the second form panel 70, whereby the alignment is extremely simplified. Thus, workability in assembling of a concrete form is remarkably improved.

A second embodiment of the present invention is now described with reference to FIGS. 4A to 9C. This embodiment is different from the aforementioned first embodiment only in shapes of a pair of attachments 32 and functions thereof, and hence elements other than the attachments are denoted by reference numerals similar to those of the first embodiment, to omit redundant description.

Figure 5:
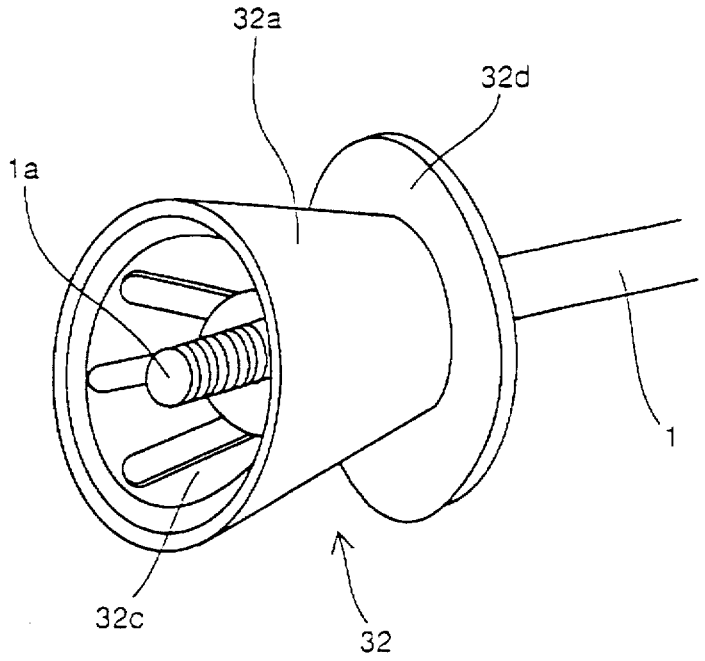
FIG. 5 is a perspective view showing a portion around an attachment of the concrete form spacing fixture 10 according to the second embodiment of the present invention in an enlarged manner.
Figure 6:
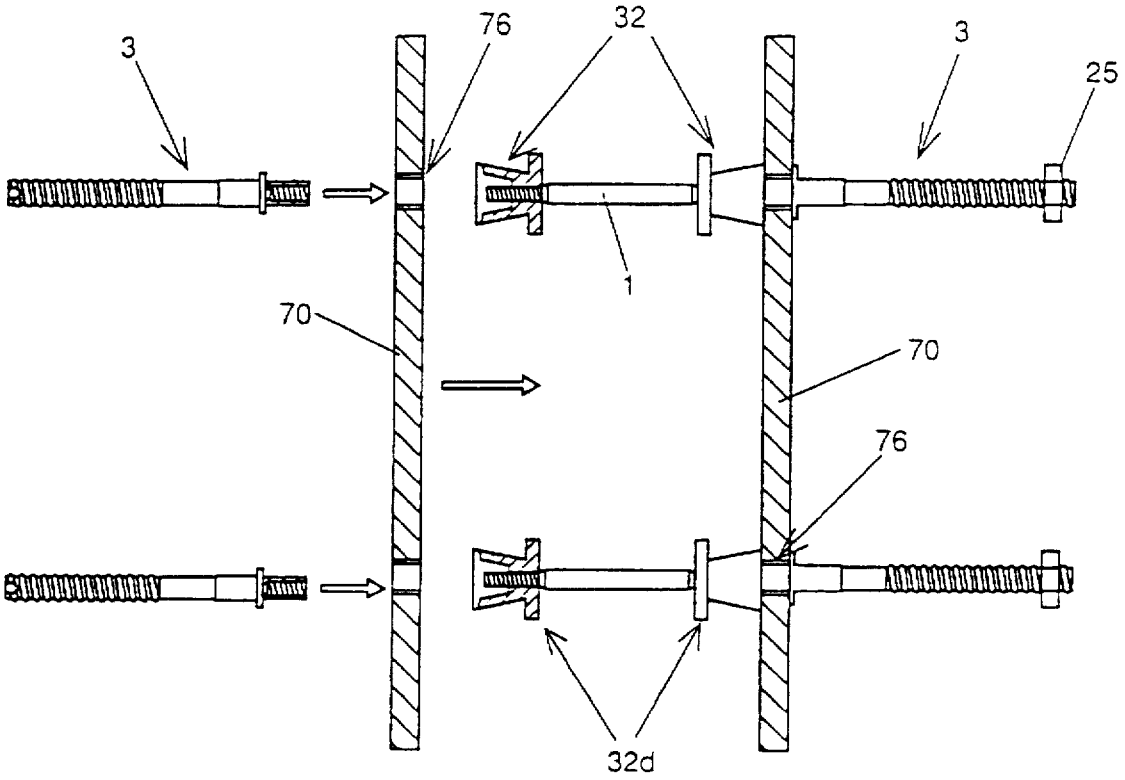
FIG. 6 is a sectional view showing the concrete form spacing fixtures according to the second embodiment of the present invention in correspondence to FIG. 3.
Figure 7:
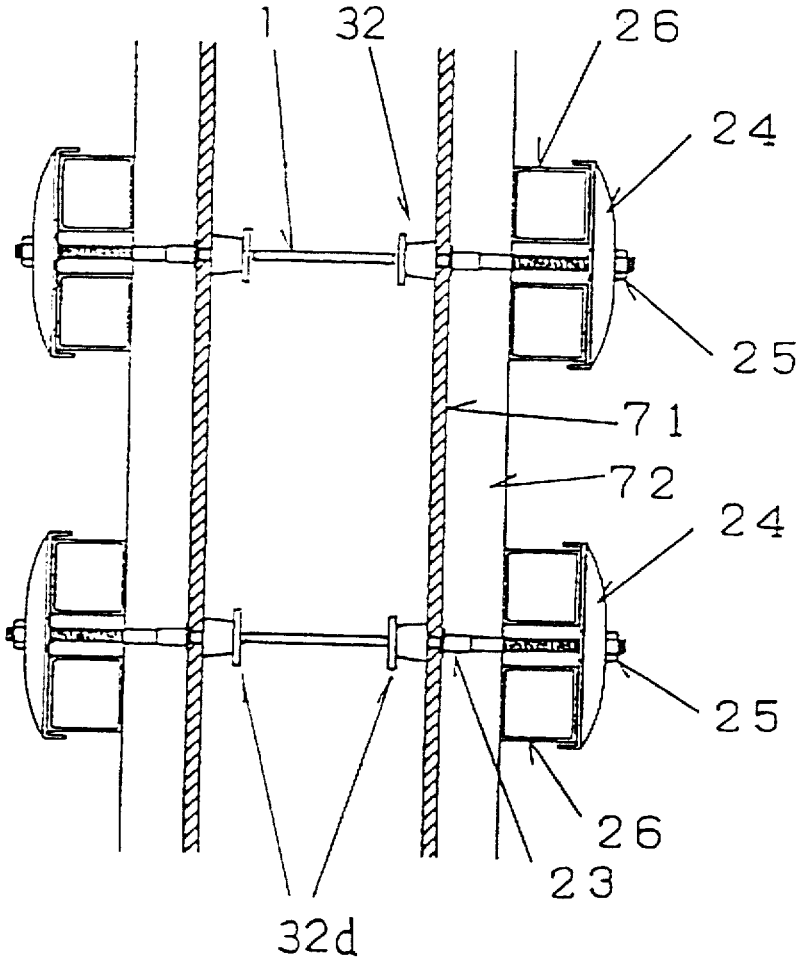
FIG. 7 is a sectional view showing a state of assembling a concrete form with the concrete form spacing fixtures according to the second embodiment of the present invention.
Figure 8:
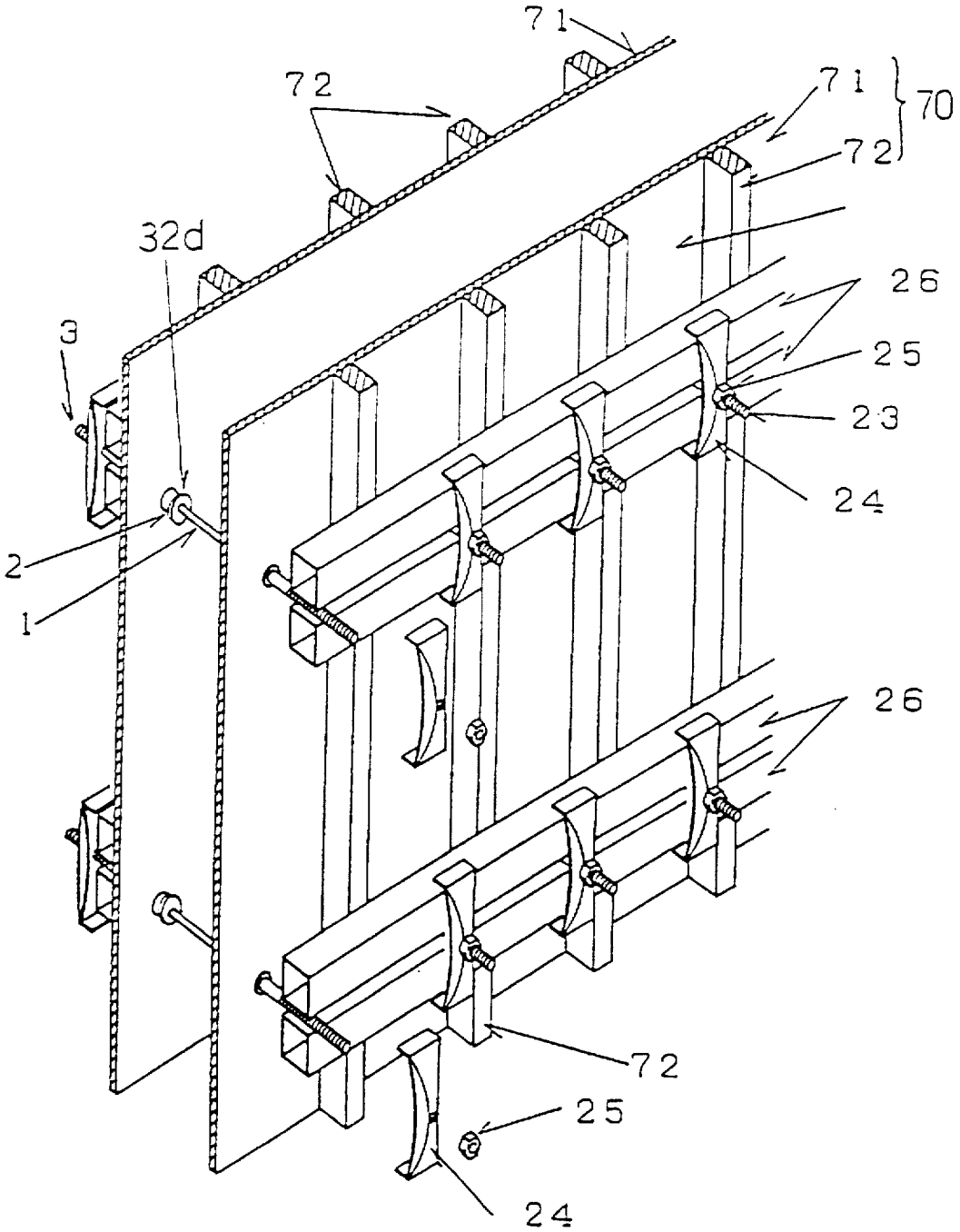
FIG. 8 is a perspective view showing the state of assembling the concrete form with the concrete form spacing fixtures according to the second embodiment of the present invention in correspondence to FIG. 12.

Each of the pair of attachments 32 according to this embodiment is similar to the attachment 2 in the aforementioned first embodiment in a point provided with a resin presser part 32*a*, a female screw 32*b* to be fitted with a male screw 1*a* of a separator 1, and a concave part 32*c* provided on an open end side. Each attachment 32 according to this embodiment is different from the attachment 2 in the aforementioned first embodiment in a point that a waterproof flange part 32*d* having a diameter which is enlarged perpendicularly to the longitudinal direction of the separator 1 in a state fitted with the separator 1 is provided on an end portion fixed to the separator 1. FIG. 5 is a perspective view showing each of the pair of attachments 32 in an enlarged manner. FIG. 6 is a sectional view showing this embodiment in correspondence to FIG. 3 showing the aforementioned first embodiment. FIG. 7 is a sectional view showing a state of a concrete form, similar to that shown in FIG. 12 which is common to the prior art and the first embodiment, to which concrete form spacing fixtures according to this embodiment are applied, and FIG. 8 is a perspective view which is similar to FIG. 12 respectively.

According to this structure, infiltration of water or the like through holes of concrete receiving the separators 1 is prevented in a state leaving the attachments 32 in the concrete after concrete placing. Consequently, no time is required for removing the attachments 32 after concrete placing, whereby the execution cost is reduced.

Figure 9A:
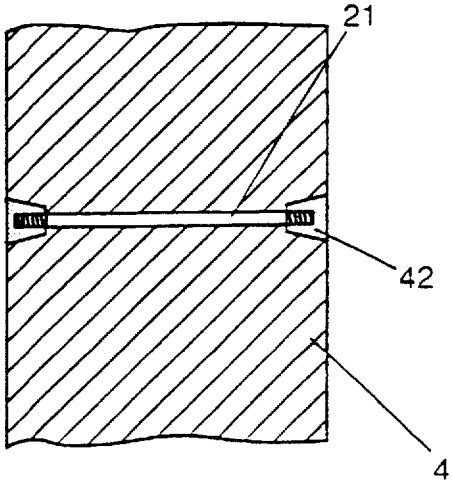
FIG. 9A PRIOR ART
FIGS. 9A, 9B and 9C, showing sections of concrete walls from which forms are removed after concrete placing for illustrating the function/effect of the second embodiment of the present invention, are sectional views showing the concrete walls in case of employing a conventional concrete form spacing fixture, in a state of employing the concrete form spacing fixture according to the first embodiment of the present invention and mounting a rubber ring to a central portion of a separator as waterproof means, and in case of employing the concrete form spacing fixture according to the second embodiment of the present invention respectively.
Figure 9B:
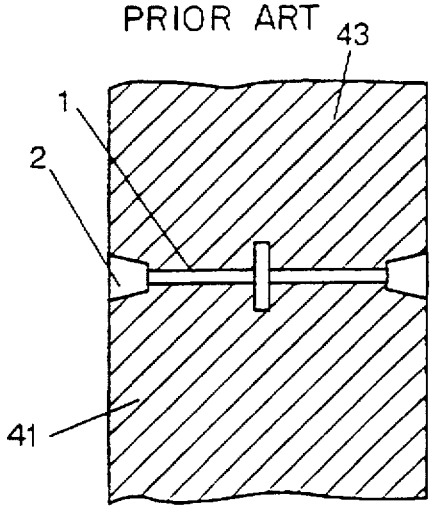
FIG. 9B PRIOR ART
Figure 9C:
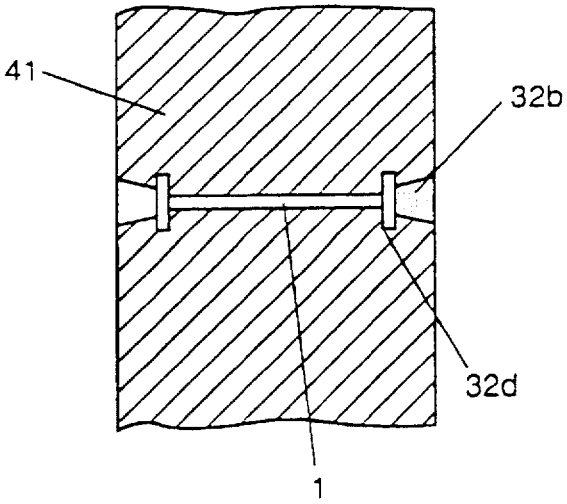
FIG. 9C PRIOR ART
Figure 10A:
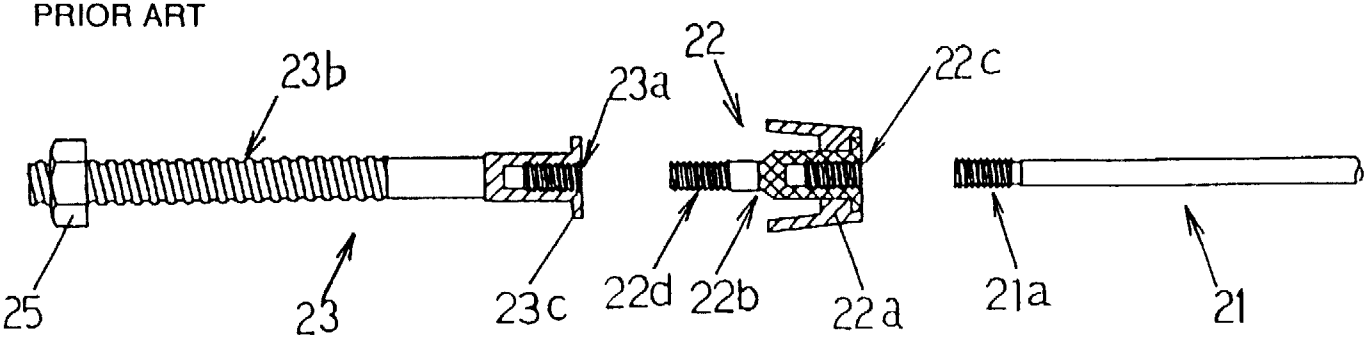
FIG. 10A PRIOR ART
FIG. 10A is a sectional view showing a conventional concrete form spacing fixture in an exploded manner.
Figure 10B:
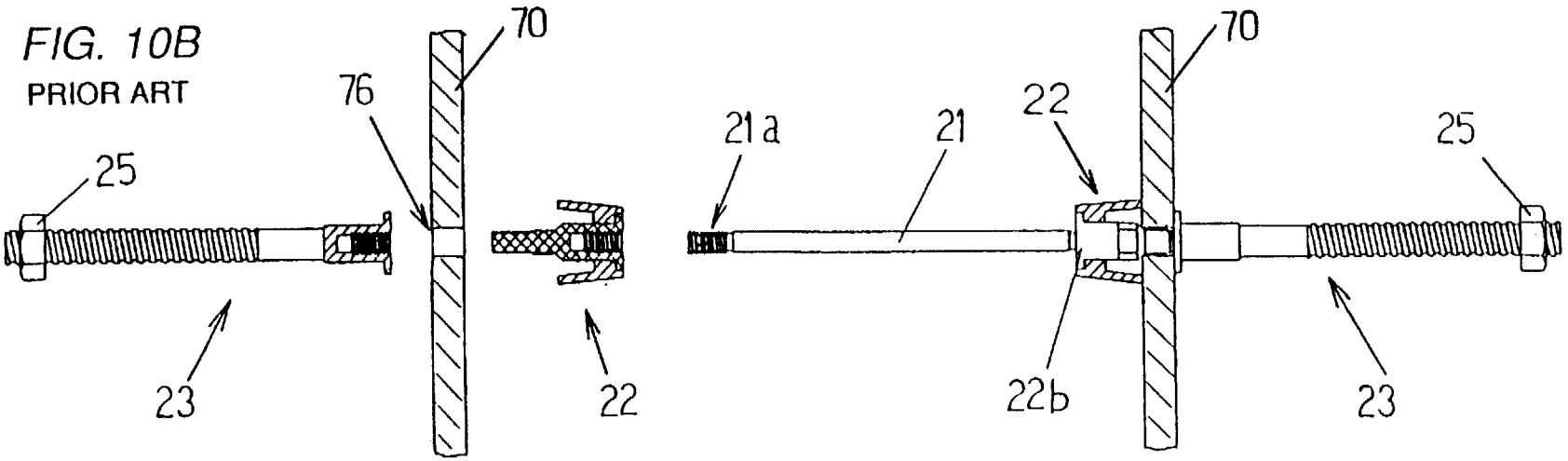
FIG. 10B PRIOR ART
FIG. 10B is a sectional view showing a state of fastening/fixing a pair of opposite form panels 70 to each other with the conventional concrete form spacing fixture shown in FIG. 10A.
Figure 11:
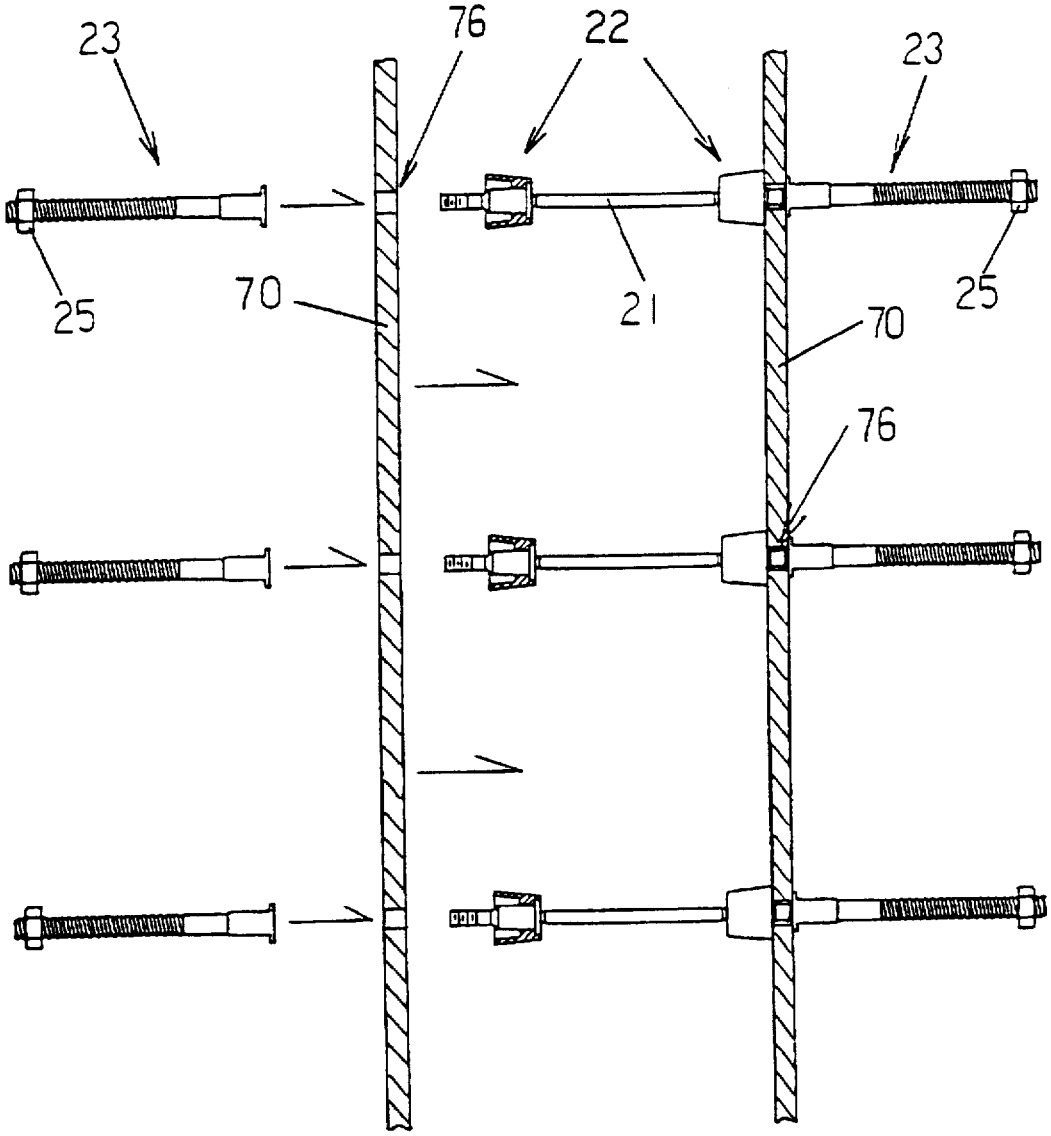
FIG. 11 PRIOR ART
FIG. 11 is a sectional view showing a state of fastening/fixing a pair of opposite form panels 70 with a plurality of conventional concrete form spacing fixtures shown in FIGS. 10A and 10B for assembling a concrete form.

With reference to FIGS. 9A to 9C, the function/effect of the attachments 32 having the waterproof flange parts 32 is described as follows: When concrete is placed with the aforementioned conventional concrete form spacing fixture, the male screw 22*d* of the attachment 22 projects from the outer surface of the concrete, and hence the attachment 22 is also removed from the concrete after removal of the form. When the concrete is left in this state, water infiltrates through a clearance defined between the separator 21 and the concrete following contraction of the concrete as hardened, leading to such a problem that the water enters the interior of a placed concrete wall 41 from outside. As shown in FIG. 9A, therefore, a concave portion 42 which is defined on the outer surface of the concrete wall 41 after removal of the attachment 22 is filled up with mortar or the like, for waterproofing the concrete wall 41.

In case of placing concrete with the concrete form spacing fixture according to the first embodiment of the present invention, on the other hand, the male screw 2*d* of the attachment 2 is stored in the concave part 2*c* not to project from the outer surface of a concrete wall 41, whereby the attachment 2 can be left in the state received in the concrete wall 41 after removal of the form. When the concrete is left in this state, however, water disadvantageously infiltrates through a clearance between the separator 21 and the concrete wall 41 following contraction of the concrete as hardened also in this case. Therefore, a discoidal rubber ring 43 may be mounted on a central portion of the separator 1 for waterproofing the concrete wall 41 as shown in FIG. 9B, for example.

In either case, however, a separate member such as the mortar or the rubber ring is employed and hence an additional step is required for filling the concave portion 42 with the mortar or mounting the rubber ring 43 on the separator 1 in execution of the concrete form, disadvantageously leading to a high execution cost.

However, the concrete form spacing fixture according to the second embodiment of the present invention enables waterproofing with no requirement for an additional step or a separate specific member in execution due to the waterproof flanges 32*d* provided on the attachments 32, as shown in FIG. 9C. The attachments 32 can be integrally formed by resin molding, whereby the working cost is hardly increased. Thus, the overall execution cost can be suppressed.

The proper thickness for the waterproof flange parts 32*d* of the attachments 32 according to this embodiment is about 2 mm, and a high waterproof effect can be attained by a double blocking function by the waterproof flange parts 32*d* of the pair of attachments 32 which are positioned on both end portions of the separator 1.

The aforementioned embodiments of the present invention are mere examples, and various modifications are employable in the scope of the present invention described in the appended claims of the present invention, as a matter of course.

What is claimed is:

1. A concrete form spacing fixture comprising:

an elongated separator of a prescribed length and provided with a male screw on its end portion;

an attachment having a concave part open on a first end, such that an open end of the concave part defines an end surface perpendicular to the longitudinal direction of the separator in a state fixing a second end of the attachment to the end portion of the separator; and a fastening member having a male screw on one end and a female screw forming part on the other end provided with a female screw to be fitted with the male screw of the separator, the female screw forming part being of an outer diameter smaller than the opening diameter of the open end of the concave part of the attachment and a stop part having a diameter enlarged to form a flange provided on a base portion of the female screw forming part, wherein the female screw forming part of the fastening member is adapted to be inserted in a hole of a concrete form and the male screw of the separator is to be fitted with the female screw of the fastening member and the inner side of the concave part of the attachment being fixed to the end portion of the separator in mounting on the concrete form, thereby holding the concrete form by the open end of the attachment and the stop part of the fastening member for fastening/fixing the same.

2. The concrete form spacing fixture in accordance with claim 1, being provided with a waterproof flange part having a diameter being enlarged perpendicularly to the longitudinal direction of said separator on said second end of said attachment.

3. A concrete form spacing fixture comprising:

an elongated separator of a prescribed length and provided with male screws on both end portions;

a pair of attachments, each having a closed end and an open end and being in the form of a truncated cone, with diameters gradually increasing from said closed end toward the open end and, at the closed end, receiving a male screw of the separator; and a pair of fastening members, each having a male screw on one end and a female screw forming part on the other end provided with a female screw to be fitted with a male screw of the separator, the female screw forming part being of an outer diameter smaller than the opening diameter of the open end of each said attachments, and a stop part of a diameter enlarged to form a flange provided on a base portion of the female screw forming part, wherein the male screws of the separator are of prescribed lengths greater than the lengths of the closed ends of the attachments and shorter than the distance between inner surfaces of said closed ends and the open ends of the attachments, and the female screw forming parts of the fastening members are adapted to be inserted in holes of a concrete form and the pair of male screws of the separators are to be fitted with and clamped to the female screws of the fastening members in mounting on the concrete form, thereby fastening/fixing the stop parts and the open ends of the attachments to each other while holding the concrete form.

4. The concrete form spacing fixture in accordance with claim 3, wherein the end opposite from the open end of each attachment is provided with a waterproof flange part having a diameter enlarged perpendicularly to the longitudinal direction of the separator.

5. The concrete form spacing fixture in claim 1, wherein said attachment having a concave part open on a first end is threaded on a second end.

6. The concrete form spacing fixture in claim 4, wherein said pair of attachments each having an open end also have another end that is threaded.

* * * * *